US006196817B1

(12) United States Patent
Tsumagari et al.

(10) Patent No.: US 6,196,817 B1
(45) Date of Patent: Mar. 6, 2001

(54) COMPRESSER WITH LUBRICATING OIL CONTROL

(75) Inventors: Yuichi Tsumagari, Toyokawa; Masami Sanuki, Chiryu; Kazuhiro Kuroki, Karriya; Hiroyuki Gennami, Kariya, all of (JP)

(73) Assignees: Denso Corporation; Kabushiki Kaisha Toyoda Jidoshokki Seisakusho, both of Kariya (JP)

( * ) Notice: Subject to any disclaimer, the term of this patent is extended or adjusted under 35 U.S.C. 154(b) by 0 days.

(21) Appl. No.: 09/438,849

(22) Filed: Nov. 12, 1999

(51) Int. Cl.[7] ..... F01C 1/02

(52) U.S. Cl. ..... 418/55.6; 418/83; 417/410.5; 184/6.16

(58) Field of Search ..... 418/55.6, 83; 184/6.16, 184/6.17, 6.18; 417/410.5

(56) References Cited

U.S. PATENT DOCUMENTS

| | | | | |
|---|---|---|---|---|
| 4,470,778 | * | 9/1984 | Mabe | 418/55.6 |
| 4,538,975 | * | 9/1985 | Tsukagoshi | 418/55.6 |
| 4,568,253 | * | 2/1986 | Wood | 184/6.16 |
| 4,624,629 | * | 11/1986 | Murayama et al. | 184/6.16 |
| 4,626,181 | * | 12/1986 | Dantigraber | 418/83 |
| 4,737,088 | * | 4/1988 | Taniguchi et al. | 418/83 |
| 4,818,198 | * | 4/1989 | Tamura et al. | 418/55.6 |
| 4,875,835 | * | 10/1989 | Nakajima et al. | 417/310 |
| 5,421,709 | * | 6/1995 | Hill et al. | 184/6.16 |
| 5,591,018 | * | 1/1997 | Takeuchi et al. | 184/6.16 |
| 5,616,018 | * | 4/1997 | Ma | 184/6.16 |
| 5,645,408 | * | 7/1997 | Fujio et al. | 418/55.6 |
| 5,720,602 | * | 2/1998 | Hill et al. | 418/55.6 |
| 5,772,407 | * | 6/1998 | Kato et al. | 184/6.16 |

FOREIGN PATENT DOCUMENTS

| | | | | |
|---|---|---|---|---|
| 59-029791 | * | 2/1984 | (JP) | 418/55.6 |
| 62-075091 | * | 4/1987 | (JP) | 418/55.6 |
| 64-032091 | * | 2/1989 | (JP) | 418/55.6 |
| 01-301972 | * | 12/1989 | (JP) | 418/55.6 |
| 02-030994 | * | 2/1990 | (JP) | 418/55.6 |
| 03-11181 | * | 1/1991 | (JP) | 418/55.6 |
| 04-121481 | * | 4/1992 | (JP) | 418/55.6 |
| 05-126066 | * | 5/1993 | (JP) | 418/55.6 |
| 06-033890 | * | 2/1994 | (JP) | 418/55.6 |
| 06-249166 | * | 9/1994 | (JP) | 418/55.6 |
| 7-71388 | | 3/1995 | (JP) . | |

* cited by examiner

*Primary Examiner*—Thomas Denion
*Assistant Examiner*—Theresa Trieu
(74) *Attorney, Agent, or Firm*—Pillsbury Winthrop LLP

(57) ABSTRACT

A first lubricating oil passage and a second lubricating oil passage, extended from a contacting surface between a partition wall and a fixed scroll are formed in the partition wall (middle housing). A recess for communicating the first lubricating oil passage with the second lubricating oil passage is formed on the fixed scroll. Accordingly, the lubricating oil amount between the first lubricating oil passage and the second lubricating oil passage is easily controlled by adjusting the size of the recess.

6 Claims, 4 Drawing Sheets

COMPRESSER WITH LUBRICATING OIL CONTROL

CROSS REFERENCE TO RELATED APPLICATION

This application is based upon and claims priority from Japanese Patent Application No. H. 10-356482 filed Dec. 15, 1998, the contents of which are incorporated herein by reference.

BACKGROUND OF THE INVENTION

1. Field of the Invention

The present invention relates to a compressor which is preferably applicable to an electric compressor for a refrigeration cycle.

2. Description of Prior Art

According to an invention disclosed in JP-A-7-71388, for example, lubricating oil flowed into a motor housing with refrigerant from a compressing mechanism is led to the compressing mechanism (sliding portion of a compressor) via a lubricating oil passage formed on a middle housing.

Generally, the lubricating oil passage is formed by drilling a hole in a housing. Thus, if the passage length is long compared to the passage bore, a drill may be easily broken, and machining may be difficult. On the other hand, if the passage bore is too large, highly pressurized refrigerant returns to low pressure side (suction side of the compressing mechanism) together with the lubricating oil, thereby reducing the efficiency of the compressor.

Then, according to the above prior art, after forming a lubricating oil passage having a comparatively large bore, a pin-shaped contraction means is inserted and installed in the lubricating oil passage to reduce cross sectional area of the lubricating oil passage, and the highly pressurized refrigerant is prevented from returning to the low pressure side (suction side of the compressing mechanism) with the lubricating oil.

According to the above prior art, however, it is necessary to install the contraction means (contraction pin) in the lubricating oil passage. Accordingly, the prior art has a disadvantage as to reducing the manufacturing cost because it requires the contraction means and certain manufacturing processes for the contraction means.

Furthermore, it is necessary to machine a counter boring at a place of the lubricating oil passage in which the contraction pin is inserted. Accordingly, the passage structure is complicated, and it may be difficult to reduce the machining processes (time) for the counter boring.

SUMMARY OF THE INVENTION

The present invention is made in light of the foregoing problems, and it is an object of the present invention to provide a compressor which can control lubricating oil supply quantity with a simple structure.

According to a compressor of the present invention, it has a first housing having a first lubricating oil passage and a second lubricating oil passage, and has a second housing attached to the first housing for forming a contacting surface between the first housing and the second housing. The second housing includes a recess formed on the contacting surface for communicating the first lubricating oil passage with the second lubricating oil passage.

Accordingly, the lubricating oil amount between the first lubricating oil passage and the second lubricating oil passage is easily controlled by adjusting the size of the recess.

Furthermore, since there is no necessity to enlarge the bore of the first and second lubricating oil passages and to install the contraction means (contraction pin) in the lubricating oil passage, the lubricating oil passage structure is simplified, and number of parts and manufacturing processes are reduced.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

DETAILED DESCRIPTION OF PREFERRED EMBODIMENTS

Figure 1:
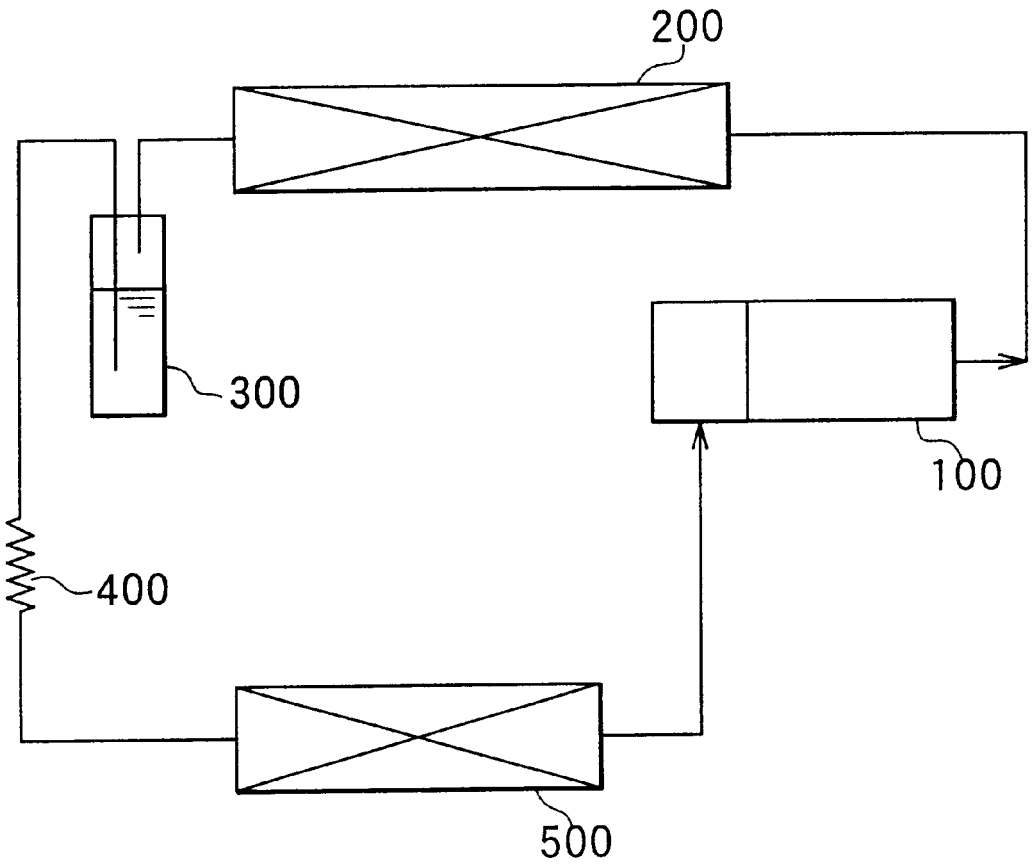
FIG. 1 is a schematic illustration of a refrigeration cycle according to a preferred embodiment of the present invention.

A preferred embodiment of the present invention is an application of a compressor 100 of the present invention to a refrigeration cycle for a vehicle (air conditioning apparatus for a vehicle). FIG. 1 is a schematic illustration of the refrigeration cycle.

A radiator (condenser) 200 cools refrigerant (fluid) discharged from the compressor 100 which sucks and compresses refrigerant (fluid). Receiver (gas-liquid separator) 300 separates gas phase refrigerant and liquid phase refrigerant of the refrigerant flows out from the radiator 200, and let the liquid phase refrigerant out, and stores excessive refrigerant in the refrigeration cycle.

The compressor 100 in this embodiment is a sealed-type electric compressor unitarily formed with later described compressing mechanism Cp, and details of the compressor 100 will be described later.

Capillary tube (pressure regulator) 400 reduces the pressure of the liquid phase refrigerant flowing out from the receiver 300. Evaporator 500 evaporates refrigerant whose pressure is reduced at the capillary tube 400.

The structure of the compressor 100 will now be described according to FIG. 2.

Compressor housing 110 made of aluminum accommodates a well known scroll type compressing mechanism Cp (hereinafter referred to as the compressing mechanism) which includes a turning scroll 111 and a fixed scroll (second housing) 112 and the like, and also functions as the fixed scroll 112.

A partition wall (first housing) 114, which separates a suction chamber 113 of the compressing mechanism Cp from a motor chamber 121 described hereinafter, is fixed to the compressor housing 110 by a bolt (not shown).

A motor housing 120, made of aluminum, comprises the motor chamber 121 which accommodates a DC brushless motor Mo (hereinafter referred to as the motor Mo) which drives the compressing mechanism Cp. The motor chamber 121 is communicated with a discharge side of the compressing mechanism Cp.

The motor Mo includes a stator coil 122 and a magnet rotor 123 which rotates in the stator coil 122. The stator coil 122 includes an approximately cylindrical stator core 122*a* and a coil 122*b* which is inserted in a slot 122*c* (see FIG. 3) of the stator core 122*a*. The stator core 122*a* is fixed in the motor housing 120 by shrink fit.

A conductor 124 is for supplying power to the stator coil 122. A terminal 125 connects external wiring (not shown) with the conductor 124. The terminal 125 is molded by resin.

One axially end of a rotor shaft (hereinafter referred to as the shaft) 126 which supports the magnet rotor 123 is connected to the turning scroll (compressing mechanism Cp) by penetrating the partition wall 114, and is rotatably supported by a radial bearing 127 fixed to the partition wall 114.

The other end of the shaft 126 is rotatably supported by a radial bearing 128 fixed to the motor housing 120. The compressor 100 is installed in an engine compartment such that the longitudinal direction of the shaft 126 is horizontal.

A discharge port 130 for discharging the refrigerant, which flows in the motor chamber 121 from the compressing mechanism Cp, toward the radiator 200 is formed at a portion of the motor housing 120 corresponding to the other end of the shaft 126 in the longitudinal direction. A first refrigerant passage 131, for communicating the motor chamber 121 with the discharge port 130 by having an opening toward the discharge port 130 at the other end in the longitudinal direction of the shaft 126, is formed in the shaft 126.

Figure 3:
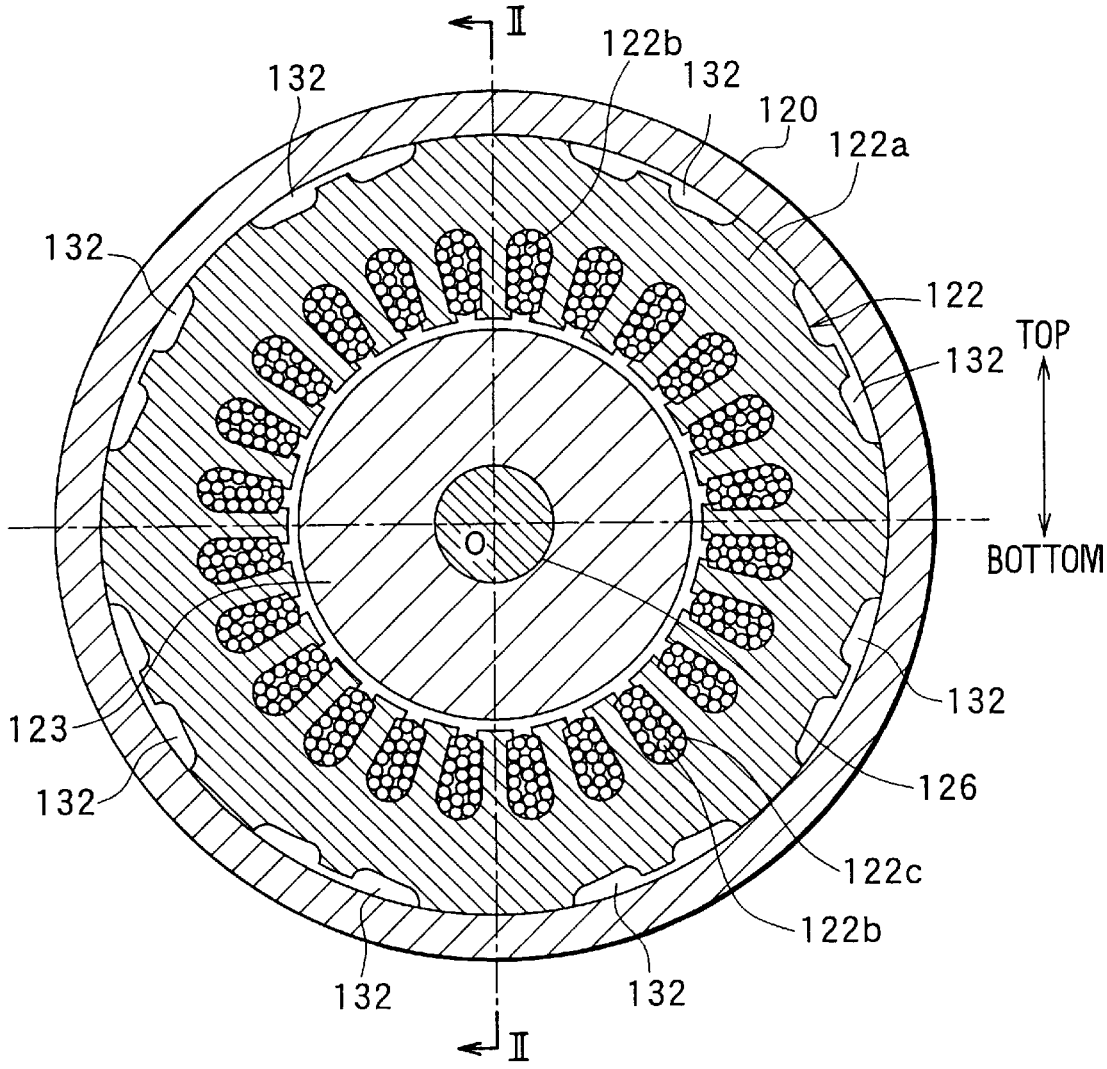
FIG. 3 is a sectional view of the compressor taken along line III—III in FIG. 2 according to the preferred embodiment.

As shown in FIG. 3, a second refrigerant passage (fluid passage) 132 for leading the refrigerant, discharged from the compressing mechanism Cp to the motor chamber 121, to the discharge port 130 is provided between the stator coil 122 (stator core 122a) and the motor housing 120. A plurality of the second refrigerant passages 132 are formed in such a manner that they are approximately parallel with the longitudinal direction of the shaft 126.

Figure 2:
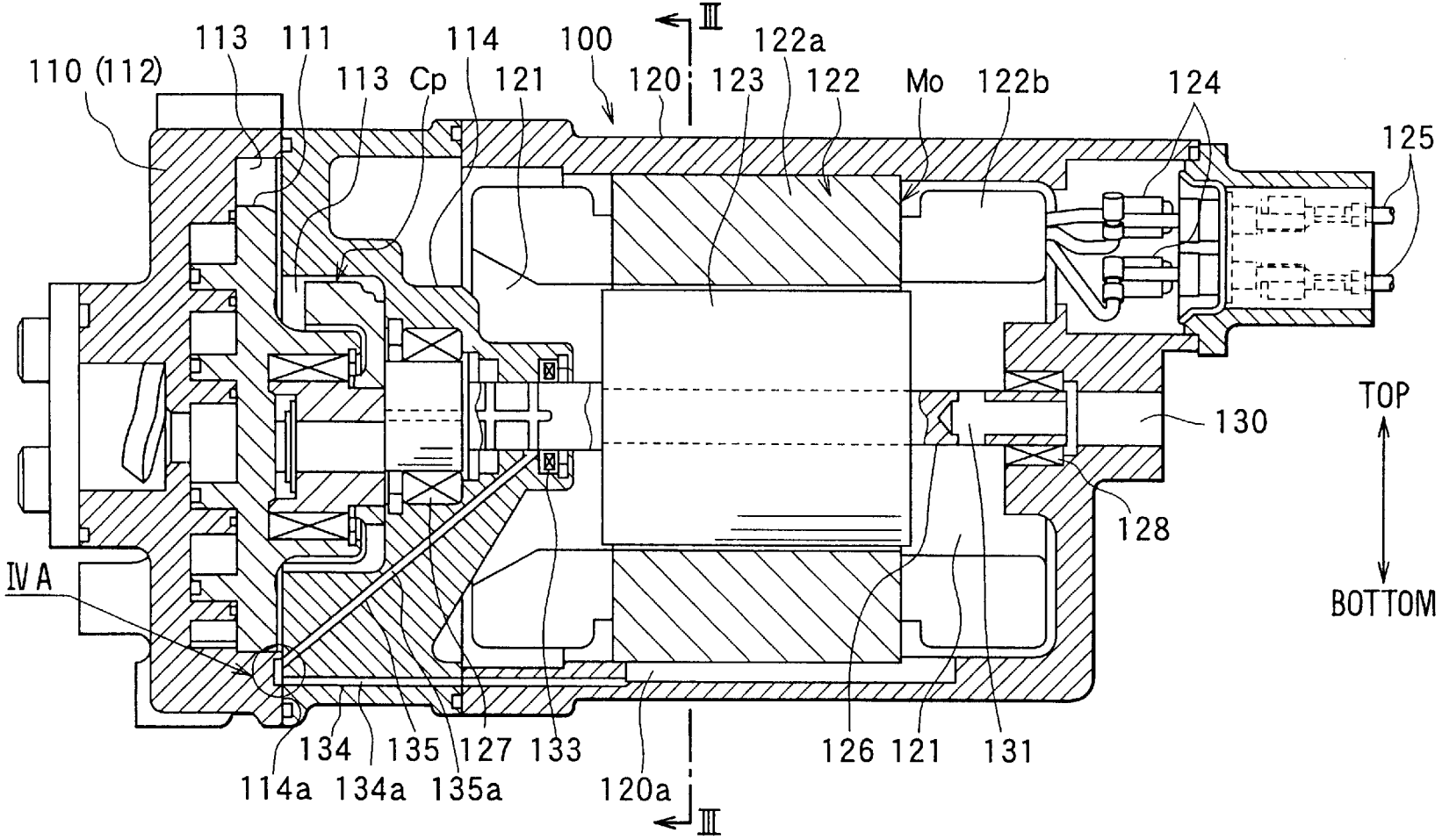
FIG. 2 is a sectional view of a compressor taken along line II—II in FIG. 3 according to the preferred embodiment.

As shown in FIG. 2, a lip seal (shaft seal device) 133 made of resin for slidably contacting the shaft 126, and for sealing a gap between the partition wall 114 and the shaft 126, and for preventing the refrigerant in the motor chamber 121 from leaking to the suction chamber 113 (suction side of the compressing mechanism Cp) is provided at a part of the partition wall 114 which is closer to the motor chamber 121 with respect to the radial bearing 127.

The partition wall (middle housing) 114 has a contact surface 114*a* which has a contact with the fixed scroll 112 (compressor housing 110). The contact surface 114*a* communicates with a first lubricating oil passage 134 and a second lubricating oil passage 135.

The first lubricating oil passage 134 is extended from the contact surface 114*a* toward the lubricating oil stored at a lower portion of the motor chamber 121 (toward an oil storing portion 120*a*). The second lubricating oil passage 135 is extended from the contact surface 114*a* toward the radial bearing 127 and the lip seal 133.

Figure 4A:
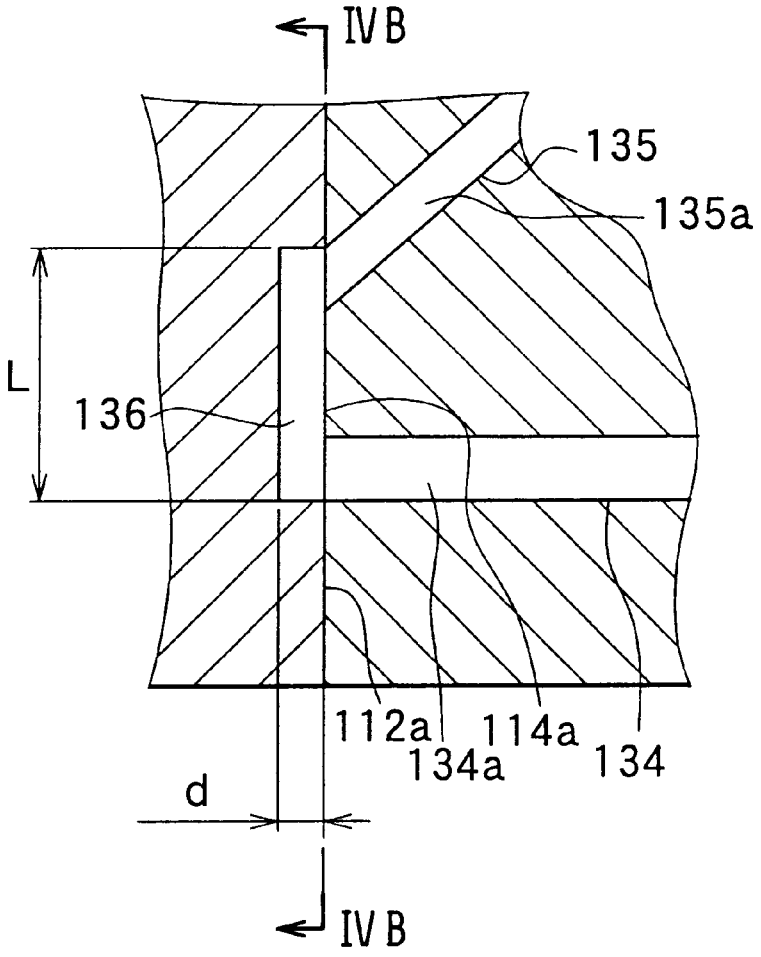
FIG. 4A is a part of an enlarged view of a portion designated by an arrow IVA in FIG. 2 according to the preferred embodiment.
Figure 4B:
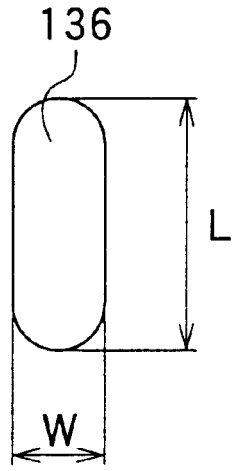
FIG. 4B is a part of a sectional view taken along line IVB—IVB in FIG. 4A according to the preferred embodiment.

As shown in FIG. 4A, a recess 136, which communicates the first lubricating oil passage 134 with the second lubricating oil passage 135 at the contact surface 114*a*, is formed on an end surface 112*a*of the fixed scroll 112 by milling, such as end milling.

Accordingly, the lubricating oil flowed in the motor chamber 121 together with the refrigerant from the compressing mechanism Cp is stored at the lower portion of the motor chamber 121 (oil storing portion 120*a*) according to density difference between the lubricating oil and the refrigerant, and is supplied to the compressing mechanism Cp, the radial bearing 127 and the lip seal 133 and the like via the first lubricating oil passage 134, the recess 136 and the second lubricating oil passage 135 according to the pressure difference between the motor chamber 121 and the suction chamber 113.

The lubricating oil supplied to the compressing mechanism Cp and the like returns to the motor chamber 121 with the refrigerant, and is supplied to the compressing mechanism Cp again.

According to the preferred embodiment of the present invention, by adjusting depth "d", longitudinal length "L", width "W" (length which is perpendicular to the length "L") and the like in order to change the volume of the recess 136, pressure loss of the lubricating oil passage from the first lubricating oil passage 134 (oil storing portion) to the second lubricating oil passage 135 (compressing mechanism Cp and the like) is easily controlled. In other words, the lubricating oil amount between the first lubricating oil passage 134 and the second lubricating oil passage 135 is easily controlled by changing the size of the recess 136.

In the preferred embodiment, the depth "d" is 60 $\mu$m–70 $\mu$m, the longitudinal length "L" is 14 mm, and the width "W" is 3 mm.

Further, according to the preferred embodiment, it is not necessary to enlarge the bore of the lubricating oil passages 134 and 135, and it is not necessary to install the contraction means (contraction pin) in the lubricating oil passage, too. Accordingly, the lubricating oil passage structure is simplified, and number of parts and manufacturing processes are reduced.

According to the compressor 100 in the preferred embodiment, since the supply amount of the lubricating oil is adjustable by a simple structure, the manufacturing cost of the compressor 100 is reduced.

Furthermore, since it is not necessary to install the contraction means (contraction pin) in the lubricating oil passage, defective unit caused by forgetting to assemble the contraction pin and the like is prevented, and reliability of the compressor 100 is improved.

In the above described preferred embodiment, a scroll type compressor is employed as compressing mechanism Cp. However, the sealed-type compressor in the present invention is not limited to the scroll type compressor, but is also applicable to other compressing mechanism such as a vane type compressor, a rolling piston type compressor and the like.

In the above described preferred embodiment, the motor Mo is a DC brushless motor. However, it is not limited to the DC brushless motor, but is also applicable to other electric motors such as an induction motor.

Furthermore, so-called open type compressor, whose compressing mechanism Cp is driven by an external driving source of an engine or the like, may be replaced by the motor Mo.

Furthermore, the present invention is not limited to a refrigeration cycle for a vehicle, but also applicable to other refrigeration cycle such as a floor type refrigeration cycle.

Although the present invention has been described in connection with the preferred embodiments thereof with reference to the accompanying drawings, it is to be noted that various changes and modifications will be apparent to those skilled in the art. Such changes and modifications are to be understood as being included within the scope of the present invention as defined in the appended claims.

What is claimed is:

1. A compressor for compressing fluid, comprising:

a first housing having a first lubricating oil passage and a second lubricating oil passage; and a second housing attached to said first housing for forming a contacting surface between said first housing and said second housing, wherein;

said second housing includes a recess formed on said contacting surface for communicating said first lubricating oil passage with said second lubricating oil passage.

2. A compressor as in claim 1, wherein;

said first housing includes an oil storing portion for storing lubricating oil; and said first lubricating oil passage communicates said recess with said oil storing portion.

3. An electrically driven compressor for compressing fluid, comprising:

a first housing having a first lubricating oil passage and a second lubricating oil passage;

a second housing attached to said first housing for forming a contacting surface between said first housing and said second housing;

a compressing mechanism housed in said first and second housings for compressing the fluid; and a motor, having a stator and a rotor which rotates in said stator, for driving said compressing mechanism, wherein;

said second housing includes a recess formed on said contacting surface for communicating said first lubricating oil passage with said second lubricating oil passage.

4. An electrically driven compressor as in claim 3, wherein;

said first housing includes an oil storing portion for storing lubricating oil; and said first lubricating oil passage communicates said recess with said oil storing portion.

5. A scroll type compressor, comprising:

a housing having a first lubricating oil passage and a second lubricating oil passage;

a shaft rotatably supported by said housing;

a turning scroll rotated by said shaft; and a fixed scroll fixed to said housing for slidably contacting said turning scroll and for forming a contacting surface between said housing and said fixed scroll, wherein;

said fixed scroll includes a recess formed on said contacting surface for communicating said first lubricating oil passage with said second lubricating oil passage.

6. A scroll type compressor as in claim 5, wherein;

said housing includes an oil storing portion for storing lubricating oil;

said first lubricating oil passage communicates said recess with said oil storing portion; and said second lubricating oil passage communicates said recess with said shaft.

* * * * *